United States Patent [19]

Owa

[11] Patent Number: 4,690,589

[45] Date of Patent: Sep. 1, 1987

[54] METHOD FOR FORMING A WATER-IMPERMEABLE LAYER IN A SOIL

[75] Inventor: Yutaka Owa, Chiba, Japan

[73] Assignee: Lion Corporation, Tokyo, Japan

[21] Appl. No.: 856,188

[22] Filed: Apr. 28, 1986

[30] Foreign Application Priority Data

Apr. 30, 1985 [JP] Japan ..... 60-92528

[51] Int. Cl.[4] ..... E02D 3/12

[52] U.S. Cl. ..... 405/263; 405/270

[58] Field of Search ..... 405/263, 270, 264, 258; 106/DIG. 900; 166/295

[56] References Cited

U.S. PATENT DOCUMENTS

| | | | |
|---|---|---|---|
| 3,552,130 | 1/1971 | Landau | 405/263 |
| 3,959,975 | 6/1976 | Graf | 405/263 |
| 4,064,940 | 12/1977 | Sparlin | 405/263 |
| 4,168,593 | 9/1979 | Jankowiak | 405/264 |
| 4,226,556 | 10/1980 | Kayahara | 405/263 |
| 4,291,069 | 9/1981 | Pilny | 405/270 |
| 4,558,741 | 12/1985 | Borchardt et al. | 166/278 |

*Primary Examiner*—Cornelius J. Husar
*Assistant Examiner*—Nancy J. Stodola
*Attorney, Agent, or Firm*—Hopgood, Calimafde, Kalil, Blaustein & Judlowe

[57] ABSTRACT

An improvement was provided in the method for forming a water-impermeable layer in a sandy soil by sprinkling an aqueous solution containing a water-soluble polymer, e.g. poly(acrylic acid), over the land so as to infiltrate the soil with the solution, according to which the water-impermeable layer can be formed at a controlled depth as desired from the ground surface by controlling the value of pH of the aqueous polymer solution in the range from 4 to 12.

2 Claims, No Drawings

METHOD FOR FORMING A WATER-IMPERMEABLE LAYER IN A SOIL

BACKGROUND OF THE INVENTION

The present invention relates to a method for forming a moisture barrier or a water-impermeable layer in a soil containing soluble salts and/or exchangeable cations or, more particularly, to a method in which a soil containing soluble salts and/or exchangeable cations is treated with an aqueous solution containing a water-soluble polymeric material so as to form a water-impermeable layer at a desired depth with an object to save the volume of water for irrigation on a sandy land, to prevent adverse influences by salinity in an arid or semi-arid land and to prevent water leakage in a dam or bank of water reservoir.

It is known and widely practiced in soil engineering that a moisture barrier or a layer impermeable to underground water is provided at a certain depth in the soil with an object to prevent loss of water of irrigation by infiltration into depth of the soil in a sandy land, to prevent adverse influences on the growth of plants caused by the salinity which has been brought up to and accumulated in the surface layer of the soil as being dissolved in and carried by the underground water rising from the depth to the surface along with the water evaporation in the daytime and to prevent water leakage in a dam or bank of water reservoir.

Such a water-impermeable layer in the soil is provided in the prior art in several different means including a sheet of a plastic resin spread underground over the whole area of the land as desired, a layer of asphalt in place of the plastic sheet and a coagulated layer of a soil-treatment agent such as a cement milk, water glass, urethane, acrylamide, salt of acrylic acid and the like in a liquid form which is injected into the soil by pressurization through a nozzle inserted into the soil where the agent is reacted and coagulated.

These prior art methods are, however, each not fully practicable due to the disadvantages and problems in one or more respects. For example, the methods using a plastic sheet or asphalt are applicable only to a relatively small land since the soil over the land must be wholly lifted and returned after the plastic sheet or the asphalt layer has been spread taking a great deal of time and labor rendering the method almost inapplicable to a large land. The method relying on the soil-treatment agent injected into the soil is not free from the troublesome preparation of the liquid agent and necessity of delicately controlling the conditions of the injection thereof. Moreover, the effectiveness of injection is limited to the very vicinity of the injection spot so that the injection should be performed at as many spots as possible in order not to leave any area untreated.

An efficient method has been proposed in Japanese Patent Kokai No. 59-202287 by the inventor together with coinventors for the formation of a water-impermeable layer in the soil by sprinkling an aqueous solution of a water-soluble polymeric material over the land so that the solution infiltrates the soil where the polymer is converted into a water-insoluble form to provide a water-impermeable layer. A problem in this method is, however, that the depth in the soil where the water-impermeable layer is formed by the insolubilization of the polymer is greatly influenced by the nature of the soil and subject to uncontrollable variation so that the advantage to be obtained by the water-impermeable layer in the soil cannot be so high as desired. Moreover, the thus formed water-impermeable layer not always has a strength high enough. The problem of the uncontrollable depth of the water-impermeable layer formed in the soil is even more serious when the soil contains a relatively large amount of soluble cations in excess of, for example, 10 meq per 100 g of dry soil.

SUMMARY OF THE INVENTION

An object of the present invention is therefore to provide an improved method for forming a moisture barrier or a water-impermeable layer in the soil at a controlled depth even when the soil contains a relatively large amount of soluble salts by sprinkling an aqueous solution of a water-soluble polymer over the land.

Another object of the invention is to provide an improved method for increasing the strength of the water-impermeable layer formed by a water-soluble polymer infiltrating the soil in the form of an aqueous solution sprinkled over the land.

Thus, the present invention provides an improvement which comprises, in a method for forming a water-impermeable layer in a soil containing 10 meq or less of cations per 100 g of the dry soil by sprinkling an aqueous solution of a water-soluble polymer, which is convertible into a water-insoluble form by reacting with the ions in a soil, over a land so that the aqueous solution infiltrates the soil and the polymer is insolubilized by reacting with the ions in the soil, controlling the value of pH of the aqueous solution, in which the concentration of soluble salts does not exceed 0.2% by weight, in the range from 4 to 12 by adding an acid or alkali so that the water-impermeable layer is formed at a controlled depth in the range from 12 to 150 cm from the ground surface.

Further, the improvement provided by the invention comprises, in addition to the above described control of the pH value of the aqueous solution of the polymer, admixing the aqueous solution with a coagulable inorganic powder so that the water-impermeable layer formed in the soil is imparted with an increased strength.

DETAILED DESCRIPTION OF THE PREFERRED EMBODIMENTS

As is understood from the above given summarizing description, the most characteristic feature of the improvement provided by the invention is the control of the pH value of the aqueous solution containing the water-soluble polymer dissolved therein in the range from 4 to 12 depending on the nature of the soil and the desired depth in the soil where the water-impermeable layer should be formed in order to fully exhibit the advantageous effect thereby. This unique improvement has been established on the basis of the discovery obtained as a result of the extensive investigations that, while the aqueous polymer solution used in the method disclosed in the above mentioned Japanese Patent Kokai No. 59-202287 always has a pH below 4, the velocity at which the water-impermeable layer is formed in a soil largely depends on the pH value of and/or the concentration of soluble salts in the aqueous solution containing the water-soluble polymer sprinkled over the land so as to provide a possibility of controlling the depth in a soil where the water-impermeable layer is formed.

Exemplary of the water-soluble polymer convertible into a water-insoluble form by reacting with the ions in a soil are poly(acrylic acid) and mixtures thereof with other water-soluble polymers as well as copolymers of acrylic acid with other comonomers. The water-soluble polymers combined with a poly(acrylic acid) include polyacrylamides, polyvinylpyrrolidones, combinations of a polyacrylamide and a polyvinylpyrrolidone and the like each in an amount of 0.01 to 100 parts by weight per part by weight of the poly(acrylic acid). The copolymers of acrylic acid includes copolymers of acrylic acid and acrylamide or N-vinyl-2-pyrrolidone in a copolymerization ratio of from 1:100 to 100:1. Ternary copolymers of acrylic acid, acrylamide and N-vinyl-2-pyrrolidone in a copolymerization ratio of 1:(0.01 to 100):(0.01 to 100) can also be used. Furthermore, mixtures of one of the above named (co)polymers or combinations of polymers with a polyvinyl alcohol in a mixing ratio of 10:100 to 100:1 by weight are also suitable. The polymer or polymers need not be completely dissolved in the solution but a part thereof may be in a finely dispersed or suspended form.

The aqueous solution to be sprinkled over the soil should contain these water-soluble polymers, copolymers or mixtures thereof dissolved therein in a concentration in the range from 0.01 to 30% by weight.

It is essential in the present invention that the aqueous solution of the water-soluble polymer should have a controlled value of pH by the addition of an acid or alkali depending on the nature of the particular soil under treatment and the desired depth at which the water-impermeable layer should be formed. The acid and alkali suitable for use in this case are exemplified by hydrochloric acid, nitric acid, sulfuric acid, phosphoric acid and the like and sodium hydroxide, potassium hydroxide, calcium hydroxide, magnesium hydroxide and the like. By this means, it is possible to freely control the depth of the water-impermeable layer formed of the insolubilized polymer within a range of, usually, from 0.12 to 1.5 meters from the ground surface.

In connection with the mechanism by which a water-impermeable layer is formed in the soil, it is presumable that the above mentioned water-soluble polymer in the aqueous solution comprising poly(acrylic acid) may undergo ion exchange with the cations forming the inorganic salts and/or exchangeable cations in the soil such as ions of sodium, potassium, calcium, magnesium, aluminum and the like to be insolubilized. In this case, it is probable that the susceptibility of the water-soluble polymer to insolubilization may be profoundly influenced by the pH value of the aqueous solution so that the depth in the soil at which the water-impermeable layer is formed is controllable by modifying the pH of the aqueous solution.

If necessary, the aqueous solution of the water-soluble polymer may be further admixed with a variety of water-soluble salts of metals such as sodium, potassium, calcium, magnesium, aluminum and the like in a suitable concentration but not exceeding 0.2% by weight so as to obtain a further increased possibility of controlling the depth of water-impermeable layer.

When it is desired to increase the strength of the water-impermeable layer formed of the water-soluble polymer, it is optional that sprinkling of the aqueous solution of the water-soluble polymer to the soil is succeeded by sprinkling of an aqueous dispersion of an inorganic coagulable particulate substance such as iron(III) hydroxide, aluminum hydroxide and the like. The aqueous dispersion should usually contain the inorganic powder in a concentration from 0.001 to 1% by weight. The aqueous dispersion may further contain a coagulation retarder such as sodium lauryl polyoxyethylene ether sulfate ($\overline{P}=3$) and the like according to need.

When the soil under treatment is excessively salty, furthermore, it is optional that the soil is desalted, for example, by sprinkling a volume of fresh water to the soil prior to sprinkling of the aqueous polymer solution.

As is understood from the above given description, the method of the present invention provides a novel means for controlling the depth of the water-impermeable layer formed of the water-soluble polymer by merely modifying the pH value of the aqueous solution and keeping the salt concentration therein below a certain upper limit so that optimum results can easily be obtained in the soil treatment according to the nature of the soil and the object of the soil treatment. Therefore, the method of the invention is practiced with an object to save the volume of irrigation water on sandy lands, prevention of adverse influences by salinity in arid or semi-arid lands, decrease of water leakage from dams and banks of water reservoirs and the like.

In the following, the method of the invention is described in more detail by way of examples.

EXAMPLE 1

Aqueous polymer solutions were prepared each by dissolving a poly(acrylic acid) having an average molecular weight of 110,000 and a polyacrylamide having an average molecular weight of 700,000 in a weight ratio of 3:1 in water in an overall polymer concentration of 0.3% by weight. The aqueous solution was admixed with a small volume of a 20% by weight aqueous solution of sodium hydroxide to partially neutralize the acidic polymer so that the aqueous solution was imparted with an increased value of pH as desired. In some experiments, the aqueous solution was further admixed with sodium chloride in a concentration of 0.02% or 0.1% by weight.

A column made of a transparent acrylic resin having an inner diameter of 50 mm and a height of 2000 mm and held upright was filled with sand having a particle size distribution of 1 mm or smaller, in which the overall content of soluble salts and exchangeable cations was about 18 meq per 100 g of dry sand, to form a sand layer of a height of 1900 mm and 1.5 liters of the above prepared aqueous solution were poured into the column to flow down in the column percolating the sand layer while a water-impermeable layer was formed in the sand layer at a varied depth from the surface of the sand layer depending on the pH value of and the concentration of sodium chloride in the aqueous solution. Table 1 summarizes the results of the experiments. As is clear from this table, the depth at which the water-impermeable layer is formed is controllable in the range from 12 to 100 cm by modifying the pH value of the aqueous polymer solution in the range from 4 to 12 with a concentration of the salt not exceeding 0.1% by weight.

TABLE 1

| pH of aqueous polymer solution | Concentration of sodium chloride, % by weight | Depth of water-impermeable layer, cm |
|---|---|---|
| 3.5* | 0 | 10 |
| 4.0 | 0 | 12 |
| 5.0 | 0 | 15 |
| 7.0 | 0 | 65 |
| 8.0 | 0 | 100 |

TABLE 1-continued

| pH of aqueous polymer solution | Concentration of sodium chloride, % by weight | Depth of water-impermeable layer, cm |
|---|---|---|
| 11.0 | 0 | 65 |
| 12.0 | 0 | 30 |
| 3.5 | 0.02 | 10 |
| 8.0 | 0.02 | 70 |
| 11.0 | 0.02 | 30 |
| 12.0 | 0.02 | 20 |
| 8.0 | 0.1 | 40 |

*pH uncontrolled

EXAMPLE 2

Aqueous polymer solutions were prepared each by dissolving the same poly(acrylic acid) and polyacrylamide as used in Example 1 in a weight ratio of 3:1 in water in an overall polymer concentration of 0.3% by weight. The aqueous solutions were admixed with an aqueous solution of sodium hydroxide so as to have a value of pH of 3.5 or 5.0. Each a portion of these solutions was admixed with calcium chloride in a concentration of 0.03% by weight.

Sand percolation test was undertaken by using these solutions in the same manner as in Example 1 except that the overall content of soluble salts and exchangeable cations in the sand was 5 meq per 100 g of dry sand to give the depths of the water-impermeable layer formed in the sand column shown in Table 2 below.

TABLE 2

| pH of aqueous polymer solution | Concentration of calcium chloride, % by weight | Depth of water-impermeable layer, cm |
|---|---|---|
| 3.5* | 0 | no layer formed |
| 5.0 | 0 | no layer formed |
| 3.5* | 0.03 | 32 |
| 5.0 | 0.03 | no layer formed |

*pH uncontrolled

EXAMPLE 3

Aqueous polymer solutions were prepared each by dissolving the same poly(acrylic acid) and polyacrylamide as used in Example 1 in a varied proportion of them in an overall polymer concentration of 0.3% by weight and sodium chloride in a concentration of 0.02% by weight. The aqueous solutions were admixed with an aqueous solution of sodium hydroxide so as to have a value of pH of 7.0 or 9.0.

The same sand percolation test through a column of the same sand as in Example 1 was undertaken by using these solutions and the depth of the water-impermeable layer formed in the sand column was recorded to give the results shown in Table 3 below.

TABLE 3

| pH of aqueous polymer solution | Weight ratio of poly(acrylic acid): polyacrylamide | Depth of water-impermeable layer, cm |
|---|---|---|
| 7.0 | 90:10 | 45 |
| 7.0 | 75:25 | 30 |
| 7.0 | 50:50 | 30 |
| 9.0 | 90:10 | 90 |
| 9.0 | 75:25 | 75 |
| 9.0 | 50:50 | 75 |

EXAMPLE 4

Aqueous polymer solutions were prepared each by dissolving the same poly(acrylic acid) and polyacrylamide as used in Example 1 in a weight ratio of 3:1 in an overall polymer concentration of 0.3% or 1.0% by weight with or without addition of sodium chloride and control of the pH by the addition of an aqueous solution of sodium hydroxide. The sand percolation test was undertaken in the same manner through a column of the same sand as in Example 1 to give the results shown in Table 4 below.

TABLE 4

| Overall polymer concentration % by weight | pH of aqueous polymer solution | Concentration of sodium chloride, % by weight | Depth of water-impermeable layer, cm |
|---|---|---|---|
| 0.3 | 7.0 | 0 | 65 |
| 0.3 | 10.0 | 0.1 | 60 |
| 1.0 | 7.0 | 0 | 82 |
| 1.0 | 10.0 | 0.1 | 79 |

EXAMPLE 5

Aqueous polymer solutions were prepared each by dissolving the same poly(acrylic acid) and polyacrylamide as used in Example 1 in a weight ratio of 3:1 in an overall polymer concentration of 0.3% by weight together with an inorganic salt as indicated in Table 5 below in a concentration of 3.4 meq/liter followed by the addition of an aqueous solution of sodium hydroxide so as to have a value of pH of 9.0. The sand percolation test was undertaken in the same manner through a column of the same sand as in Example 1 using these aqueous polymer solutions to give the results of the depth of the water-impermeable layer as shown in Table 5. As is understood from these results, the kind of the inorganic salt also has an influence on the depth of the water-impermeable layer formed in the sand column.

TABLE 5

| Inorganic salt | Depth of water-impermeable layer, cm |
|---|---|
| Sodium chloride | 76 |
| Potassium chloride | 73 |
| Calcium chloride | 70 |
| Magnesium chloride | 56 |
| Aluminum chloride | 20 |

EXAMPLE 6

An aqueous solution A having a pH of 7.0 was prepared by dissolving the same poly(acrylic acid) and polyacrylamide as used in Example 1 in a weight ratio of 3:1 in an overall polymer concentration of 0.3% by weight with addition of a 20% by weight aqueous solution of sodium hydroxide.

Separately, another aqueous solution B having a pH of 7.0 was prepared by dissolving 152 ppm of iron(III) chloride and 100 ppm of sodium lauryl polyoxyethylene ether sulfate ($\overline{P}=3$) having an activity as a retarder of the formation of the water-impermeable layer in water with addition of the aqueous solution of sodium hydroxide.

A sand column was prepared in the same manner using the same sand as in Example 1 whidh was percolated first with 0.5 liter of the aqueous solution A and then with 1.5 liters of the aqueous solution B so that a water-impermeable layer of high strength was formed at a depth of 70 cm from the surface of the sand layer.

EXAMPLE 7

The same column of acrylic resin as used in Example 1 was filled with dry sand having a particle size distribution of 1 mm or smaller and containing 1% by weight of sodium chloride, the overall content of soluble salts and exchangeable cations therein being 35 meq per 100 g of dry sand, to form a sand layer having a height of 1900 mm which was percolated first with 1 liter of fresh water to flow down therethrough followed by standing as such for 1 hour. Thereafter, the thus washed sand layer was percolated with 0.4 liter of an aqueous polymer solution having a pH of 8.0 by the addition of sodium hydroxide and containing the same poly(acrylic acid) and polyacrylamide in a weight ratio of 3:1 in an overall polymer concentration of 0.3% by weight so that a water-impermeable layer was formed at a depth of about 100 cm from the surface. This result was in good consistency with that obtained by use of the same sand without admixture of sodium chloride.

What is claimed is:

1. In a method for forming a water-impermeable layer in a soil containing 10 meq or less of cations per 100 g of the dry soil by sprinkling an aqueous solution of a water-soluble polymer, which is convertible into a water-insoluble form by reacting with the ions in a soil, over a land so that the aqueous solution infiltrates the soil and the polymer is insolubilized by reacting with the ions in the soil, an improvement which comprises controlling the value of pH of the aqueous solution, in which the concentration of soluble salts does not exceed 0.2% by weight, in the range from 4 to 12 by adding an acid or alkali so that the water-impermeable layer is formed at a controlled depth in the range from 12 to 150 cm from the ground surface.

2. The improvement as claimed in claim 1 which further comprises sprinkling an aqueous dispersion of a coagulable inorganic particulate substance over the land following sprinkling of the aqueous solution of a water-soluble polymer having a controlled value of pH.

* * * * *